US011435086B2

(12) United States Patent
Cadima

(10) Patent No.: US 11,435,086 B2
(45) Date of Patent: Sep. 6, 2022

(54) COOKTOP APPLIANCE AND METHODS OF OPERATION

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 291 days.

(21) Appl. No.: 16/686,562

(22) Filed: Nov. 18, 2019

(65) Prior Publication Data

US 2021/0148575 A1 May 20, 2021

(51) Int. Cl.
*F24C 3/12* (2006.01)
*F24C 3/02* (2021.01)
(Continued)

(52) U.S. Cl.
CPC ..... *F24C 3/126* (2013.01); *F23K 5/007* (2013.01); *F23N 1/005* (2013.01); *F23N 5/025* (2013.01); *F24C 3/027* (2013.01); *F24C 15/107* (2013.01); *F24C 15/108* (2013.01); *F23K 2400/201* (2020.05); *F23K 2900/05002* (2013.01); *F23N 2225/14* (2020.01)

(58) Field of Classification Search
CPC ..... F24C 3/126; F24C 3/027; F24C 15/107; F24C 15/108; F23K 5/16; F23K 2400/201; F23K 2900/05002; F23K 2900/05001; F23K 5/007; F23N 1/005; F23N 2225/14; F23N 5/025; F23N 2237/02; F23N 2900/05005
USPC ..... 126/39, 152 B
See application file for complete search history.

(56) References Cited

U.S. PATENT DOCUMENTS 3,100,995 A * 8/1963 Woodward ..... G01K 1/143 374/141
6,663,009 B1 * 12/2003 Bedetti ..... F24C 3/126 126/374.1

(Continued)

FOREIGN PATENT DOCUMENTS

KR 101802776 B1 * 12/2017
KR 101802776 B1 12/2017
WO WO-2015151044 A2 * 10/2015 ..... F24C 15/107

*Primary Examiner* — Steven B McAllister
*Assistant Examiner* — Daniel E. Namay
(74) *Attorney, Agent, or Firm* — Dority & Manning, P.A.

(57) ABSTRACT

A cooktop appliance includes a first burner and a second burner which are spaced apart with a grate positioned above the burners. The grate includes a first sensor finger with a first temperature sensor over the first burner and a second sensor finger with a second temperature sensor over the second burner. The cooktop appliance also includes a first control valve and a second control valve which selectively direct fuel to the respective burners. A controller of the cooktop appliance is operably coupled to the temperature sensors and the control valves. The controller may be operable for and/or methods of operating the cooktop appliance may include receiving a set temperature, receiving a first temperature measurement from the first temperature sensor and a second temperature measurement from the second temperature sensor, and adjusting each control valve based on the set temperature and the corresponding temperature measurement.

18 Claims, 12 Drawing Sheets

(51) Int. Cl.

| | |
|---|---|
| ***F24C 15/10*** | (2006.01) |
| ***F23N 1/00*** | (2006.01) |
| ***F23K 5/00*** | (2006.01) |
| ***F23N 5/02*** | (2006.01) |
| *F23N 5/26* | (2006.01) |

(56) References Cited

U.S. PATENT DOCUMENTS

| | | | | |
|---|---|---|---|---|
| 9,175,858 | B2 * | 11/2015 | Tisselli | F24C 3/122 |
| 10,222,070 | B2 * | 3/2019 | Cadima | F24C 3/085 |
| 10,260,755 | B2 * | 4/2019 | Bach | H05B 1/0261 |
| 10,845,057 | B1 * | 11/2020 | Smith | F23N 5/245 |
| 11,162,689 | B2 * | 11/2021 | Bardal | F24C 15/107 |
| 2002/0175213 | A1 * | 11/2002 | Wodeslavsky | F24C 3/126 236/20 A |
| 2009/0104573 | A1 * | 4/2009 | Chen | F24C 3/103 431/72 |
| 2013/0265159 | A1 * | 10/2013 | Durian | F24C 3/126 340/540 |
| 2018/0142897 | A1 | 5/2018 | Cadima | |
| 2018/0340691 | A1 | 11/2018 | Cadima | |
| 2019/0212012 | A1 * | 7/2019 | Le | G08B 21/14 |
| 2021/0095854 | A1 * | 4/2021 | Trice | F24C 3/008 |
| 2021/0131674 | A1 * | 5/2021 | Bardal | F24C 15/107 |
| 2021/0172607 | A1 * | 6/2021 | Cadima | F24C 3/126 |
| 2021/0239538 | A1 * | 8/2021 | Cadima | F23D 14/72 |
| 2021/0404666 | A1 * | 12/2021 | Cadima | F24C 3/126 |
| 2022/0049852 | A1 * | 2/2022 | Bardal | F24C 15/107 |

* cited by examiner

COOKTOP APPLIANCE AND METHODS OF OPERATION

FIELD OF THE INVENTION

The present subjection matter relates generally to cooktop appliances, such as cooktop appliances with multiple gas burners for heating a griddle assembly.

BACKGROUND OF THE INVENTION

Cooking appliances, e.g., cooktops or ranges (also known as hobs or stoves), generally include one or more heated portions for heating or cooking food items within or on a cooking utensil placed on the heated portion. For instance, burners may be included with each heated portion. The heated portions utilize one or more heating sources to output heat, which is transferred to the cooking utensil and thereby to any food item or items that are disposed on or within the cooking utensil. For instance, a griddle may be provided to extend across one or more heated portions. When disposed above the heated portion, the griddle generally provides a substantially flat cooking surface.

Although a griddle may provide a flat cooking surface, difficulties may arise in dispersing or spreading heat across the flat cooking surface. Generally, heat from the burners of the appliance is directly transferred to the griddle according to the footprint of the burner. In turn, heat may be uneven across various portions of the flat cooktop surface. This may result in one portion of the flat cooking surface being heated to a significantly higher temperature than the rest of the flat cooking surface (i.e., creating "hot spots"). If the griddle extends over multiple burners, such hot spots may be increasingly problematic and cause food items thereon to be cooked unevenly. It can be difficult to balance the heat output of multiple burners. Moreover, since the relative heat output of the multiple burners may vary, a user may accidentally overheat the griddle and/or food thereon.

Some existing systems have attempted to address these issues by including a single elongated burner over which a griddle may be arranged. For example, certain gas cooktop appliances with integrated griddles include an elongated burner for more evenly heating the integrated griddle. However, elongated burners can provide limited utility outside of heating griddles. Also, consumers generally only use griddles occasionally. Moreover, a size of integrated griddles may be limited due to the need to center the integrated griddle over the gas burners. Integrated griddles can also block a significant portion of airflow to the gas burner as well as exhaust from the gas burner, which leads to poor combustion and excessive heating of cooktop components.

Accordingly, a gas cooktop appliance with features for evenly heating a removable griddle would be useful. In particular, a gas cooktop appliance with features for evenly heating a large griddle across multiple burners would be useful.

BRIEF DESCRIPTION OF THE INVENTION

Aspects and advantages of the invention will be set forth in part in the following description, or may be obvious from the description, or may be learned through practice of the invention.

In one aspect of the present disclosure, a cooktop appliance is provided. The cooktop appliance includes a first burner and a second burner spaced apart from the first burner. The cooktop appliance also includes a grate with a plurality of fingers positioned above the first burner and the second burner. The plurality of fingers include a first sensor finger with a first temperature sensor mounted thereto positioned over the first burner and a second sensor finger with a second temperature sensor mounted thereto positioned over the second burner. The cooktop appliance also includes a first control valve in fluid communication with the first burner to selectively direct a flow of gas thereto and a second control valve in fluid communication with the second burner to selectively direct a flow of gas thereto. A controller of the cooktop appliance is operably coupled to the first temperature sensor, the second temperature sensor, the first control valve, and the second control valve. The controller is operable to receive a set temperature, receive a first temperature measurement from the first temperature sensor, and to receive a second temperature measurement from the second temperature sensor. The controller is further operable to adjust the first control valve based on the first temperature measurement and the set temperature and to adjust the second control valve based on the second temperature measurement and the set temperature.

In another aspect of the present disclosure, a method of operating a cooktop appliance is provided. The cooktop appliance includes a first burner and a second burner spaced apart from the first burner. The cooktop appliance also includes a first control valve in fluid communication with the first burner to selectively direct a flow of gas thereto and a second control valve in fluid communication with the second burner to selectively direct a flow of gas thereto. The method includes positioning a grate having a plurality of fingers above the first burner and the second burner. The grate is positioned above the first burner and the second burner such that a first temperature sensor mounted to a first sensor finger of the plurality of fingers is positioned over the first burner and a second temperature sensor mounted to a second sensor finger of the plurality of fingers is positioned over the second burner. The method also includes receiving a set temperature, receiving a first temperature measurement from the first temperature sensor, and receiving a second temperature measurement from the second temperature sensor. The method also includes adjusting the first control valve based on the first temperature measurement and the set temperature and adjusting the second control valve based on the second temperature measurement and the set temperature.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
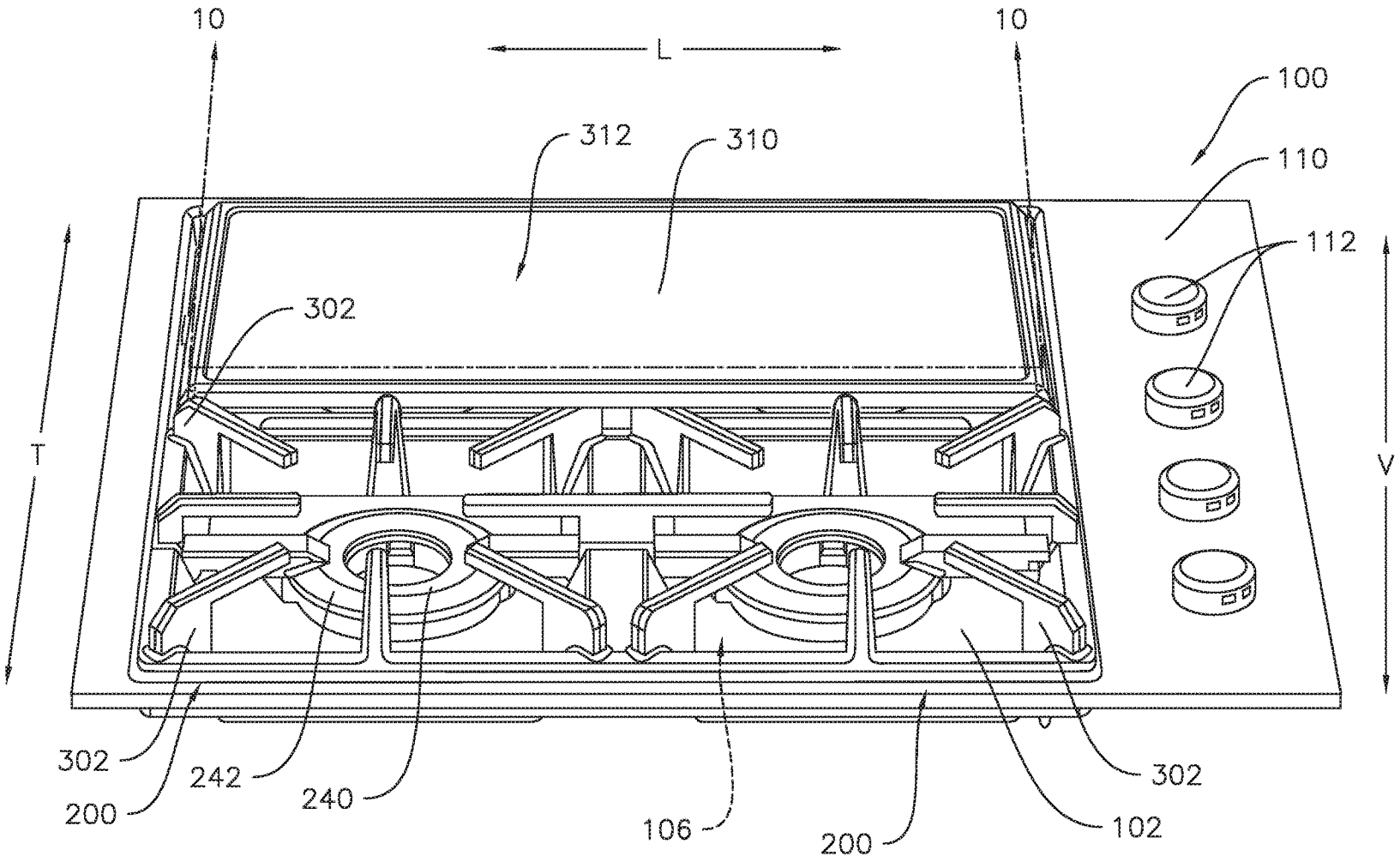
FIG. 1 provides a perspective view of a cooktop appliance according to one or more example embodiments of the present disclosure, with a griddle plate provided on a grate of thereof in a mounted position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

In some aspects of the present disclosure, a cooktop appliance having a removable griddle is provided. Generally, and as will be described in detail below, the cooktop appliance may be configured to simultaneously control multiple gas burners based on measured temperatures at multiple locations on a griddle when the griddle is placed across the multiple gas burners.

FIGS. 1 through 8 illustrate one or more example embodiments of a cooktop appliance 100 as may be employed with the present disclosure. The example cooktop appliance 100 includes a panel 102 (e.g., a top panel) that extends in a lateral direction L and a transverse direction T. By way of example, the panel 102 may be constructed of enameled steel, stainless steel, glass, ceramics, and combinations thereof.

For the cooktop appliance 100, a utensil holding food and/or cooking liquids (e.g., oil, water, etc.) may be placed onto or above one or more gas burner assemblies 200 at a location of any gas burner assembly 200. The gas burner assemblies 200 can be configured in various sizes so as to provide e.g., for the receipt of cooking utensils (i.e., pots, pans, etc.) of various sizes and configurations and to provide different heat inputs for such cooking utensils. Each gas burner assembly 200 includes a burner 240 supported on a top surface 104 of panel 102, as discussed in greater detail below. During use, the gas burner assemblies 200 may generally provide thermal energy to cooking utensils above panel 102.

A user interface panel 110 is located within convenient reach of a user of the cooktop appliance 100. For this example embodiment, the user interface panel 110 includes user inputs, such as knobs 112, that are each associated with one of the gas burner assemblies 200 (e.g., in certain operating modes). The knobs 112 may allow the user to activate each burner assembly 200 and determine an amount of heat input provided by each gas burner assembly 200 to a cooking utensil located on/above the burner assembly 200. The user interface panel 110 may also be provided with one or more graphical display devices that deliver certain information to the user—e.g., whether a particular burner assembly is activated and/or the level at which the burner assembly is set.

Operation of the cooktop appliance 100 can be regulated by a controller 130 (FIGS. 10 and 11) that is operably coupled to (i.e., in operative communication with) the user interface panel 110 and/or gas burner assemblies 200. For example, in response to user manipulation of the knobs 112 of user interface panel 110, the controller 130 operates one or more of the burners 240 of gas burner assemblies 200. By way of example, the controller 130 may include a memory and one or more processing devices such as microprocessors, CPUs or the like, such as general or special purpose microprocessors operable to execute programming instructions or micro-control code associated with operation of appliance 100. The memory may represent random access memory such as DRAM, or read only memory such as ROM or FLASH. In some embodiments, the processor may execute non-transitory programming instructions stored in memory. For example, the instructions may include a software package configured to operate appliance 100 and execute an operation routine such as the example method 500, described below with reference to FIG. 12. The memory may be a separate component from the processor or may be included onboard within the processor.

The controller 130 may be disposed in a variety of locations throughout appliance 100. In example embodiments, the controller 130 may be located under or next to the user interface panel 110. In such an embodiment, input/output ("I/O") signals are routed between the controller 130 and various operational components of appliance 100, such as the gas burner assemblies 200, controls 112, a graphical display, one or more sensors, and/or one or more alarms. In one embodiment, the user interface panel 110 may represent a general purpose I/O ("GPIO") device or functional block.

Although shown with multiple knobs 112, it should be understood that knobs 112 and the configuration of the cooktop appliance 100 shown in FIGS. 1 through 9 are provided by way of example only. More specifically, the user interface panel 110 may include various input components, such as one or more of a variety of touch-type controls, electrical, mechanical or electro-mechanical input devices including rotary dials, push buttons, and touch pads. The user interface panel 110 may include other display components, such as a digital or analog display device designed to provide operational feedback to a user. The user interface 110 may be in communication with the controller 130 via one or more signal lines or shared communication busses. The user interface 110 may be located on a different surface of the appliance, for instance, an angled front edge or a vertical backsplash.

The cooktop appliance 100 shown in FIGS. 1 through 9 illustrates various example embodiments of the present disclosure. Thus, although described in the context of cooktop appliance 100, the present disclosure may be used in cooktop appliances having other configurations, e.g., a cooktop appliance with fewer burner assemblies or additional burner assemblies. Similarly, the present disclosure may be used in cooktop appliances that include an oven, i.e., range appliances.

Figure 10:
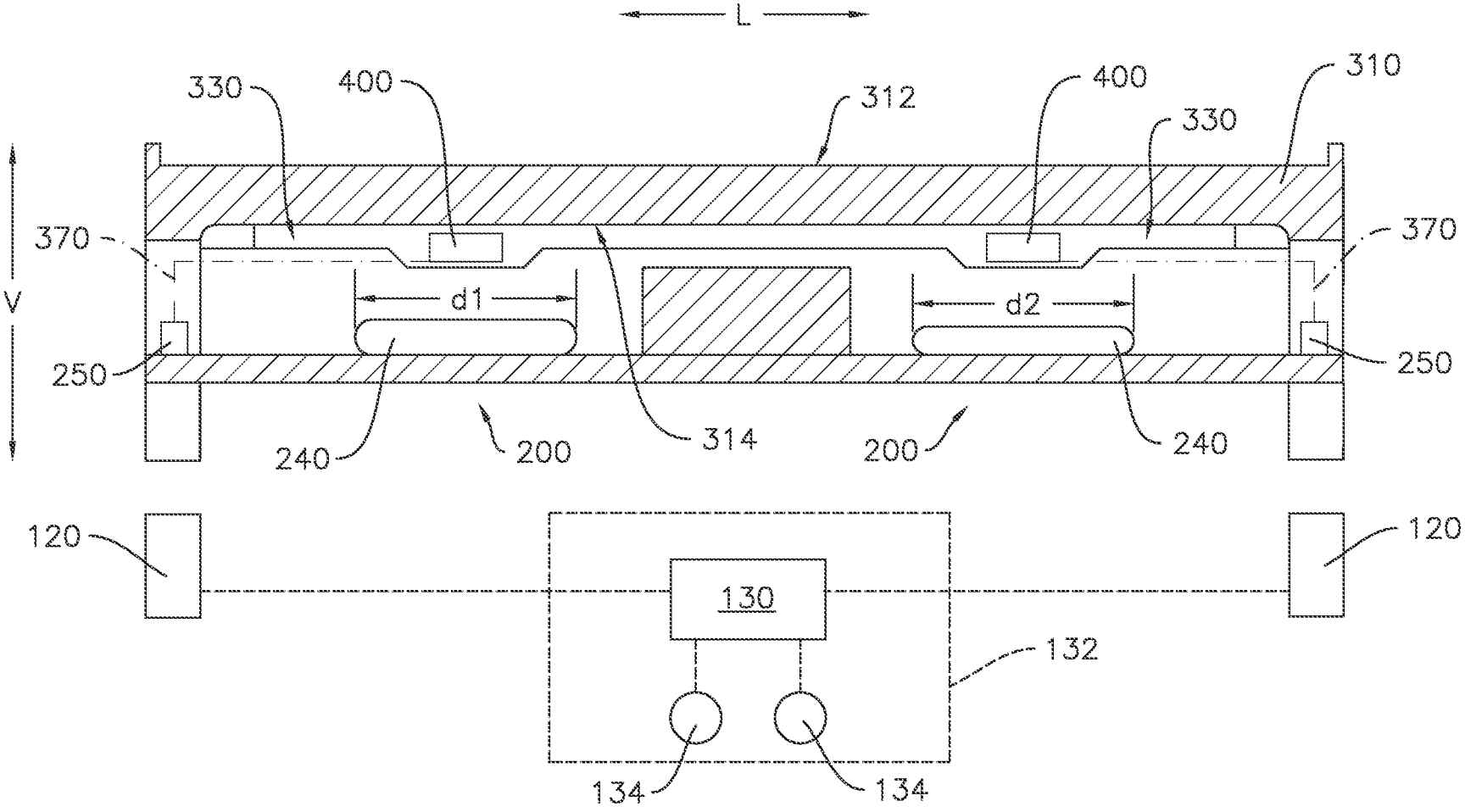
FIG. 10 provides a cross-sectional schematic view of an example cooktop appliance, such as the example cooktop appliance of FIG. 1 viewed along the line 10-10.

As illustrated in FIG. 10, the cooktop appliance 100 includes a control valve 120 associated with, e.g., in fluid communication with and configured to selectively permit, limit, or prevent a flow of fuel to, each burner 240. For example, the cooktop appliance 100 may include at least a first burner 240A and a second burner 240 B, with a respective first control valve 120A and second control valve 120B connected to each burner 240. Control valves 120 may be generally provided as any suitable valve (e.g., an electronic gas control valve) for selectively limiting the flow of gas therethrough. Control valves 120 may be mounted beneath panel 102 (e.g., to a bottom surface 106 of panel 102). Fuel lines may also be disposed below the top panel 102, e.g., at or adjacent a bottom surface 106 of panel 102). Generally, it is understood that the fuel lines extend between control valves 120 and each respective burner assembly 200. Thus, the control valves 120 may be coupled to the fuel lines. Fuel lines or conduits are generally understood by those of ordinary skill in the art and, as such, are not illustrated or described in further detail herein for the sake of brevity and clarity. The control valves 120 are each coupled to a respective one of the knobs 112. Thus, a user may adjust one or more of the control valves 120 with the knobs 112. The control valves 120 are configured for regulating fuel flow to gas burner assemblies 200. For example, each control valve 120 blocks fuel flow to gas burner assemblies 200 when control valves 120 are closed. Conversely, each control valve 120 permits fuel flow to a gas burner assembly 200 when control valves 120 are open. A user may selectively adjust control valves 120 between the open and closed configurations (e.g., with the knobs 112) in order to limit or regulate fuel flow to gas burner assemblies 200. When the control valves 120 are open, fuel, such as propane or natural gas, may flow through the fuel lines to the gas burner assemblies 200, where the fuel may be subsequently combusted. For instance, a spark igniter (not pictured) may be disposed on the panel 102 (e.g., within a burner ring 242) and may provide a spark to ignite fuel from a corresponding adjacent burner 240.

Generally, each gas burner assembly 200 includes a burner 240. In some embodiments, the burner 240 includes a generally circular shape from which a flame may be emitted. In the example embodiments of FIGS. 1 through 6, each burner 240 includes a burner ring 242 disposed on top panel 102. As shown, the example burner ring 242 extends circumferentially about a central void 265. Moreover a plurality of flame ports 254 is defined circumferentially (e.g., such that multiple flame ports 254 are defined, each being at a discrete radial point about the central void 265) in fluid communication with an internal passage of the burner ring 242.

In various embodiments, burner 240 may have a single burner ring 242 or burner 240 may be a multi-ring burner. For example, such a multi-ring burner may have an inner burner ring and an outer burner ring concentrically disposed such that the outer burner ring extends around the inner burner ring. An inner fuel chamber may be separated from an outer fuel chamber by a wall within the burner, and the burner may be configured to supply fuel to a plurality of flame ports on the inner burner and outer burner, respectively. In some embodiments of a cooktop appliance, multiple burners of differing types may be provided in combination, e.g., one or more single-ring burners as well as one or more multi-ring burners. Moreover, other suitable burner configurations are also possible.

A grate 302 may be provided extending at least partially above a corresponding burner 240 when the grate 302 is in a mounted position. Generally, the grate 302 is configured for supporting a cooking utensil, such as a pot, pan, etc., in the mounted position. For example, the grate 302 of the exemplary embodiment includes a plurality of elongated members or fingers 324, e.g., formed of cast metal, such as cast iron. The cooking utensil may be placed on the fingers 324 of the grate 302 such that the cooking utensil rests on an upper surface of fingers 324. The grate 302 may include an outer frame 304 that extends around or defines a perimeter of the grate 302 and/or gas burner assembly 200. Thus, the outer frame 304 may be disposed at an outer portion of the grate 302. As shown, the outer frame 304 of grate 302 may be square or rectangular in certain exemplary embodiments. In some embodiments, one or more grates 302 may be selectively removable (e.g., to an unmounted position), such that the grate 302 can be readily lifted from the panel 102 and placed away from the corresponding burner 240, e.g., for cleaning of the panel 102 around the burner(s) 240.

Figure 2:
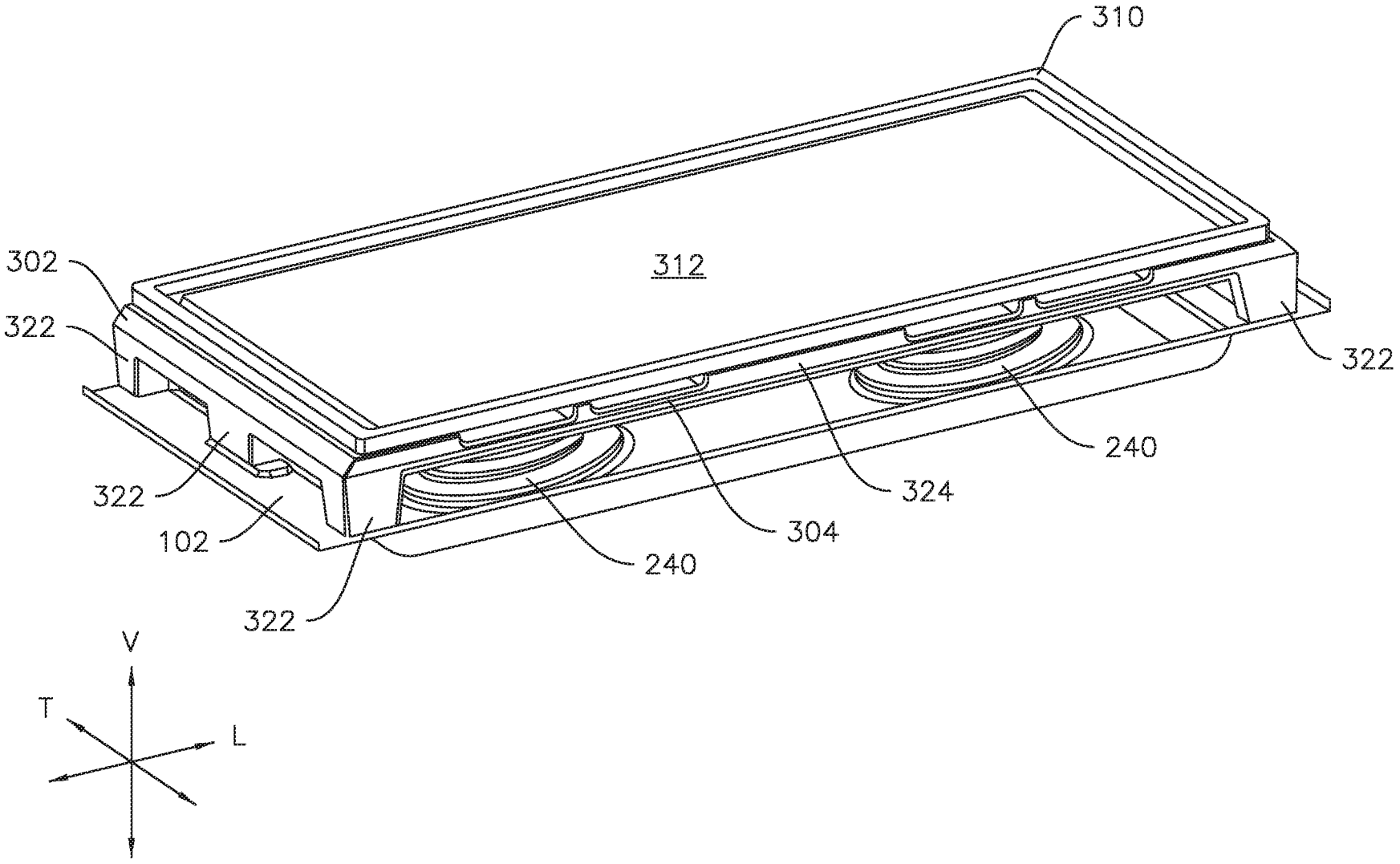
FIG. 2 provides a perspective view of a cooktop appliance, or a portion of a cooktop appliance, such as a portion of the example cooktop appliance of FIG. 1, according to one or more example embodiments of the present disclosure.
Figure 3:
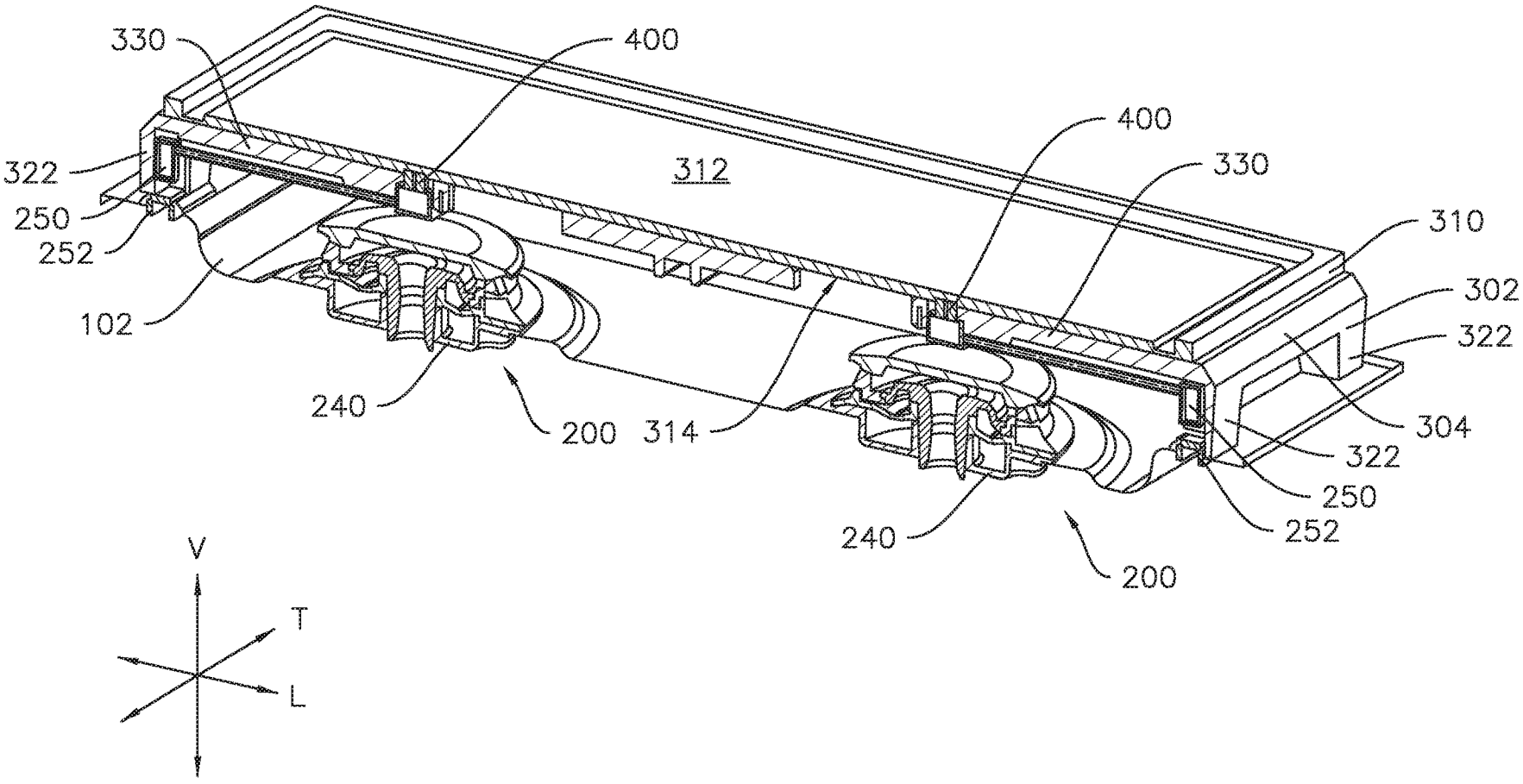
FIG. 3 provides a longitudinal section view of the cooktop appliance of FIG. 2.

As generally indicated across FIGS. 1 through 3, the grate 302 may be configured to receive a griddle plate 310 (e.g., in a mounted position). For instance, the griddle plate 310 may be selectively disposed on top of the grate 302 to receive heat from two discrete gas burner assemblies. I Moreover, it is understood that further additional or alternative embodiments of the griddle plate 310 may be placed over more than two burner assemblies (i.e., to receive heat output from three or more burner assemblies).

As shown in FIGS. 1 through 5, the griddle plate 310 may be disposed over the panel 102 (e.g., along the vertical direction V) in a mounted position. Griddle plate 310 defines a top cooking surface 312 and a bottom heating surface 314 below and beneath top cooking surface 312. For example, as illustrated, the top cooking surface 312 and the bottom heating surface 314 may be spaced apart along the vertical direction V and may be oppositely oriented along the vertical direction V. In example embodiments, griddle plate 310 is a generally planar member. In turn, top cooking surface 312 may be a substantially flat surface. Moreover, one or both of top cooking surface 312 and bottom heating surface 314 may extend perpendicular to the vertical direction V, e.g., in a lateral-transverse plane defined by the lateral direction L and the transverse direction T. Griddle plate 310 may have any suitable shape. For example, griddle plate 310 may be substantially rectangular or square, e.g., in a plane that is perpendicular to the vertical direction V.

As best seen in FIGS. 1 through 8, the grate 302 may be positioned on the top surface 104 of the panel 102 and may selectively locate and support the griddle plate 310 above the burners 200. The grate 302 may thusly be positioned above the first burner 240 and the second burner 240, e.g., along the vertical direction V. For instance, in some embodiments, the grate 302 may span two burners 240, e.g., the grate 302 may consist of a single piece spanning across the first burner and the second burner, thereby defining a frame which holds and supports the griddle plate 310 above the burners 240. The grate 302 may include the frame 304, legs 322, and a plurality of fingers 324. For example, the griddle assembly may include or consist of four corners, and may have a leg 322 extending generally along the vertical direction V at each corner. The grate 302 may also include additional legs 322 between the corners. Legs 322 may be positioned on panel 102, e.g., may extend from the frame 304 of the grate 302 to the top surface 104 of panel 102. The plurality of fingers 324 may extend from the frame 304, e.g., upwardly and/or towards gas burner 240. The frame 304 may also include a cross-bar 306 extending through and/or across the frame 304 at about the middle of the frame 304, e.g., from front to back across the frame 304. Fingers 324 support the griddle plate 310 above the gas burners 240. For example, the griddle plate 310 may rest on a top surface 326 of fingers 324 above the gas burners 240. Grate 302 may be formed of cast metal, such as cast iron or aluminum, such that the frame 304, cross-bar 306, legs 322, and fingers 324 are formed from a single, seamless piece of metal.

The plurality of fingers 324 includes a first sensor finger 330 and a second sensor finger 330. As discussed in greater detail below, sensor fingers 330 each support a temperature sensor 400, and the two temperature sensors 400 are selectively operable in concert to measure a temperature of the griddle plate 310 on grate 302 or independently to measure one or more temperatures of separate utensils (e.g., a pot or pan, as mentioned above) on one or each of the first and second burners 240. As may be seen in FIGS. 3 through 8, each sensor finger 330 defines a slot 332 at a bottom 334 of the sensor finger 330. Each slot 332 is open and faces downward, e.g., along the vertical direction V, such as towards the panel 102 when the grate 302 is in the mounted position on the panel 102. Thus, slot 332 is exposed and accessible at the bottom 334 of each sensor finger 330.

Figure 4:
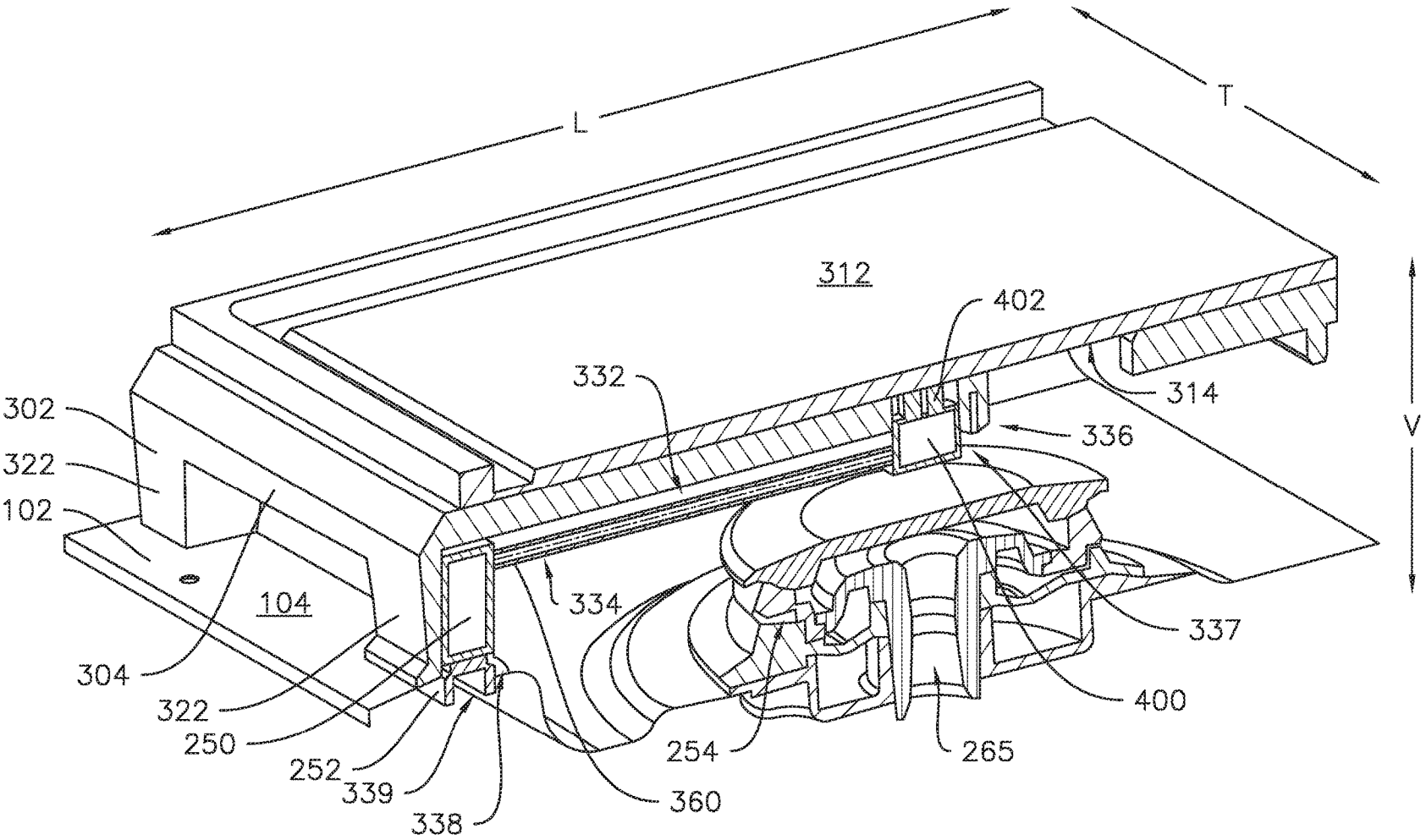
FIG. 4 provides a longitudinal section view of a portion of the cooktop appliance of FIG. 2.
Figure 8:
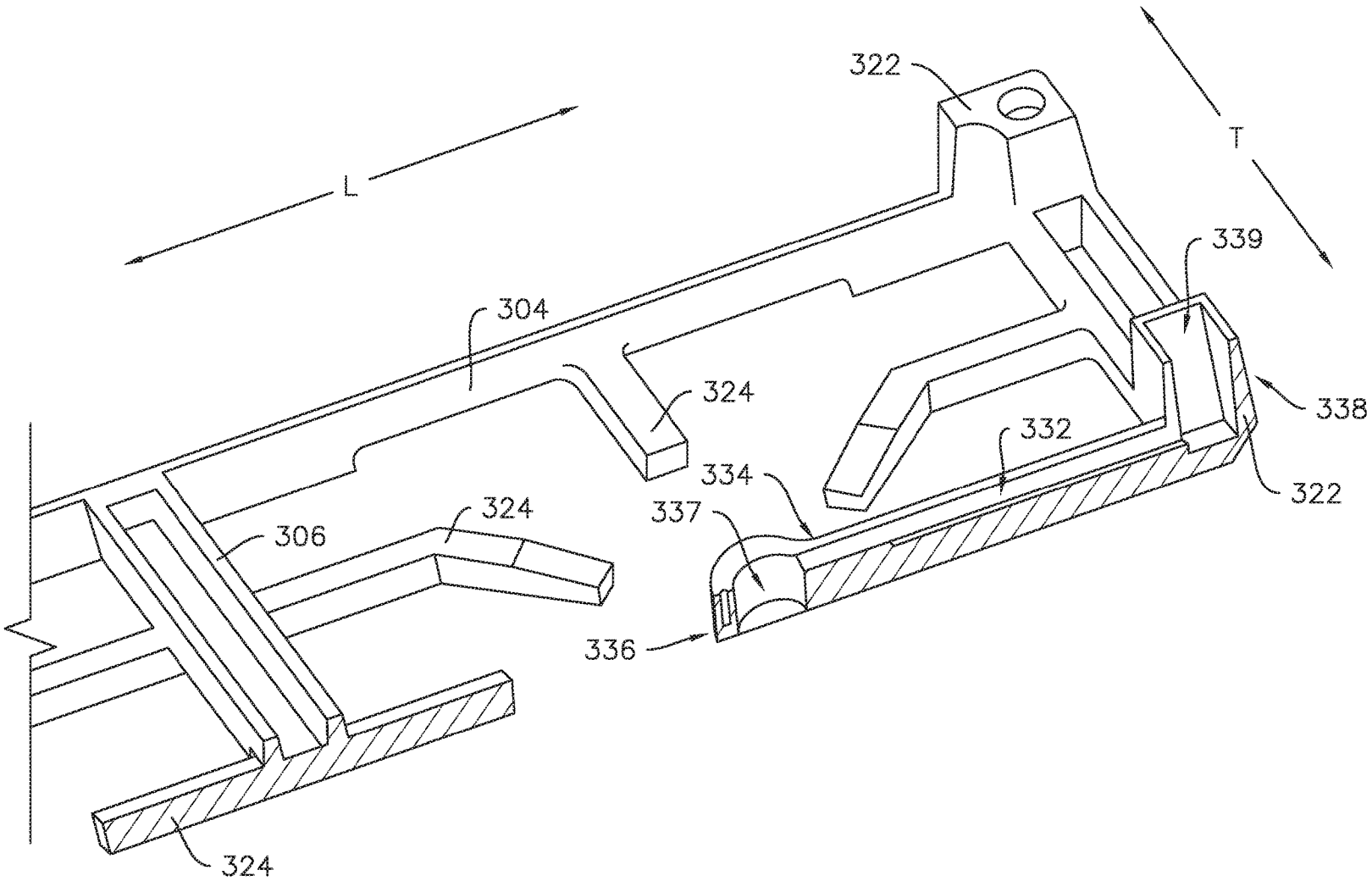
FIG. 8 provides a longitudinal section view of a portion of the grate of FIG. 7.

As best seen in FIGS. 4 and 8, the sensor finger 330 extends between a first end 336 and a second end 338. In some embodiments, sensor finger 330 may be elongated between first and second ends 336, 338 of sensor finger 330. Second end 338 of sensor finger 330 may be positioned at a leg 322 of the grate 302. Conversely, first end 336 of sensor finger 330 may be spaced from leg 322, e.g., and may be positioned above gas burner 240. Slot 332 may also extend between a first end 337 and a second end 339. First end 337 of slot 332 may be positioned at first end 336 of sensor finger 330, and second end 339 of slot 332 may be positioned at second end 338 of sensor finger 330. Thus, slot 332 may extend along the length of sensor finger 330.

A temperature sensor 400 is mounted to each sensor finger 330. For example, temperature sensor 400 may be positioned at first end 336 of sensor finger 330 and/or first end 337 of slot 332. For example, temperature sensor 400 may be positioned over gas burner 240 on sensor finger 230. In particular, temperature sensor 400 may be positioned concentric with gas burner 240 on sensor finger 330. Thus, temperature sensor 400 may be positioned on sensor finger 330 such that temperature sensor 400 is operable to measure and/or detect the temperature of a portion of the griddle plate 310 on the grate 302, such as the portion of the griddle plate 310 which is within and heated by the burner footprint of a corresponding burner 240. Temperature sensor 400 may be a resistance temperature detector, a thermocouple, an infrared temperature sensor, a bimetallic switch, etc.

Figure 5:
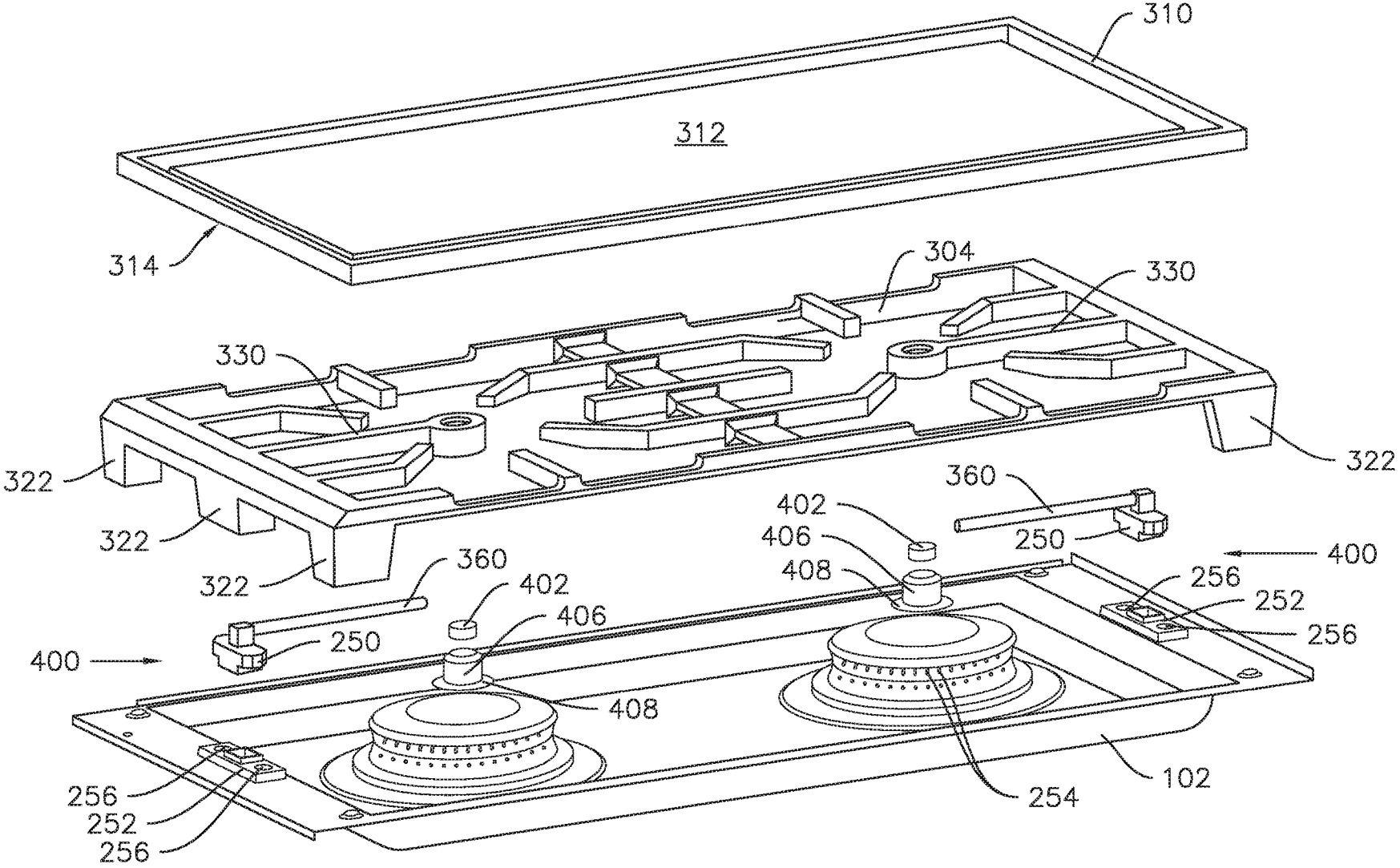
FIG. 5 provides an exploded view of the cooktop appliance of FIG. 2.
Figure 6:
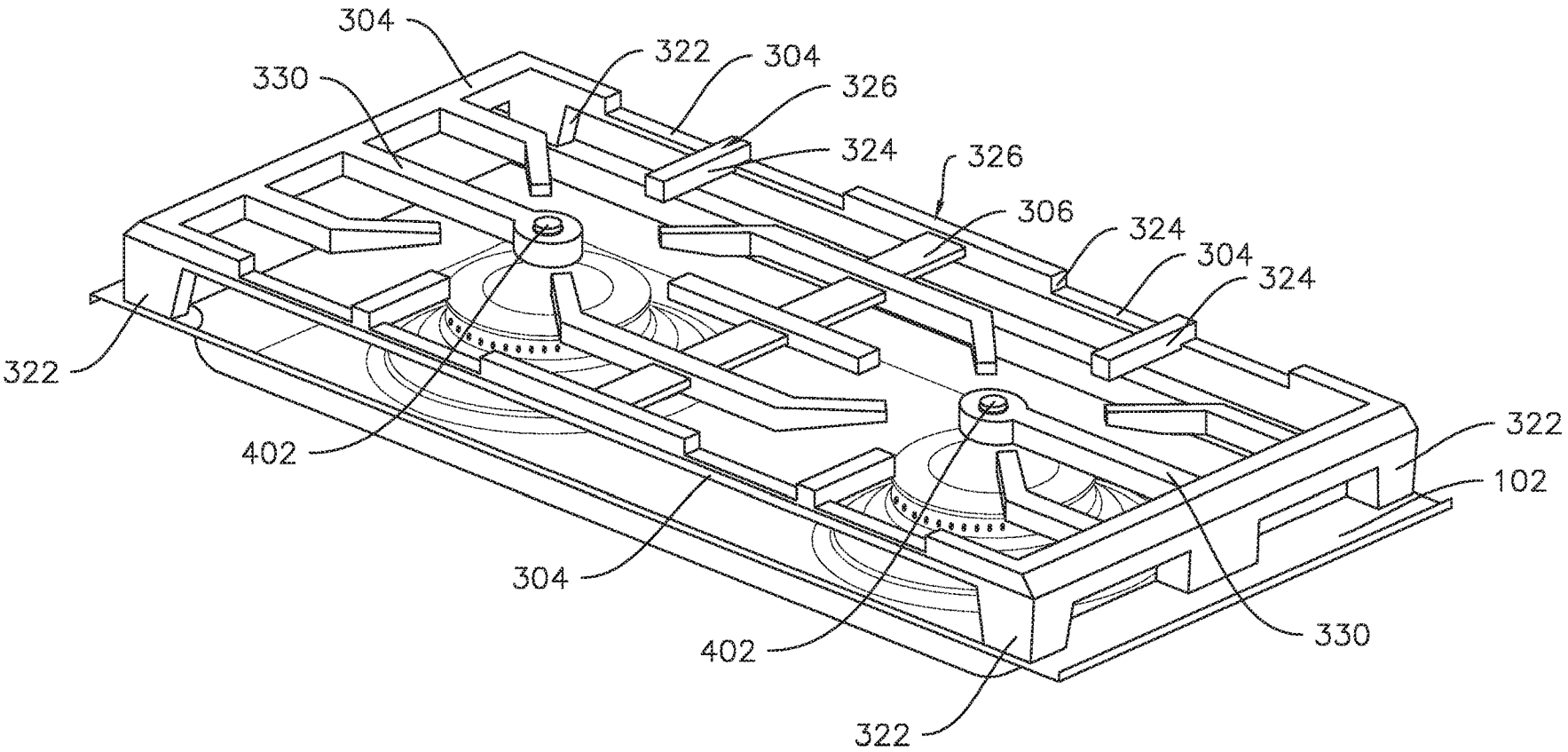
FIG. 6 provides a perspective view of the cooktop appliance of FIG. 2 with a griddle plate of the griddle removed.
Figure 7:
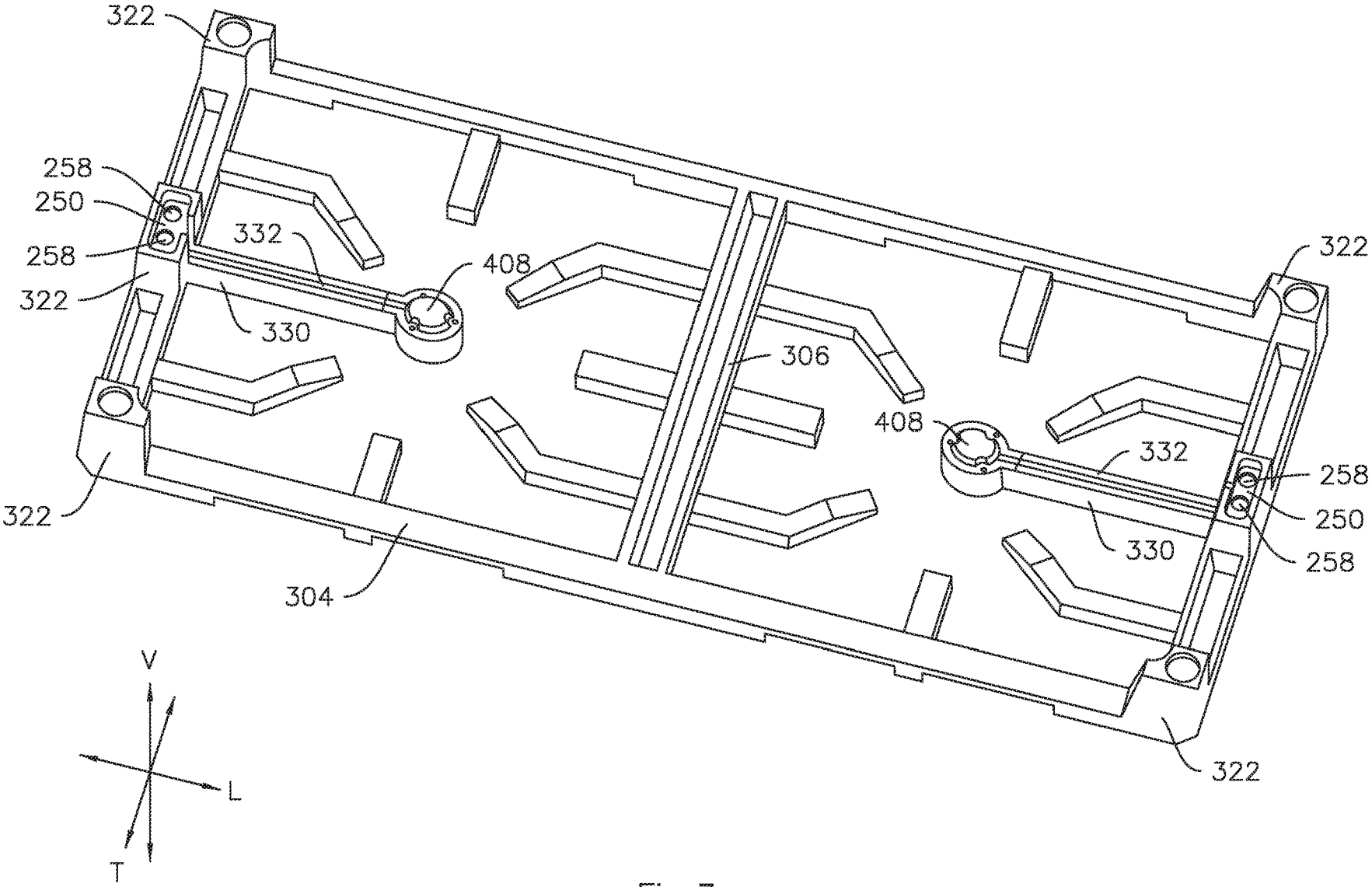
FIG. 7 provides a perspective view of a grate of the cooktop appliance of FIG. 2.
Figure 9:
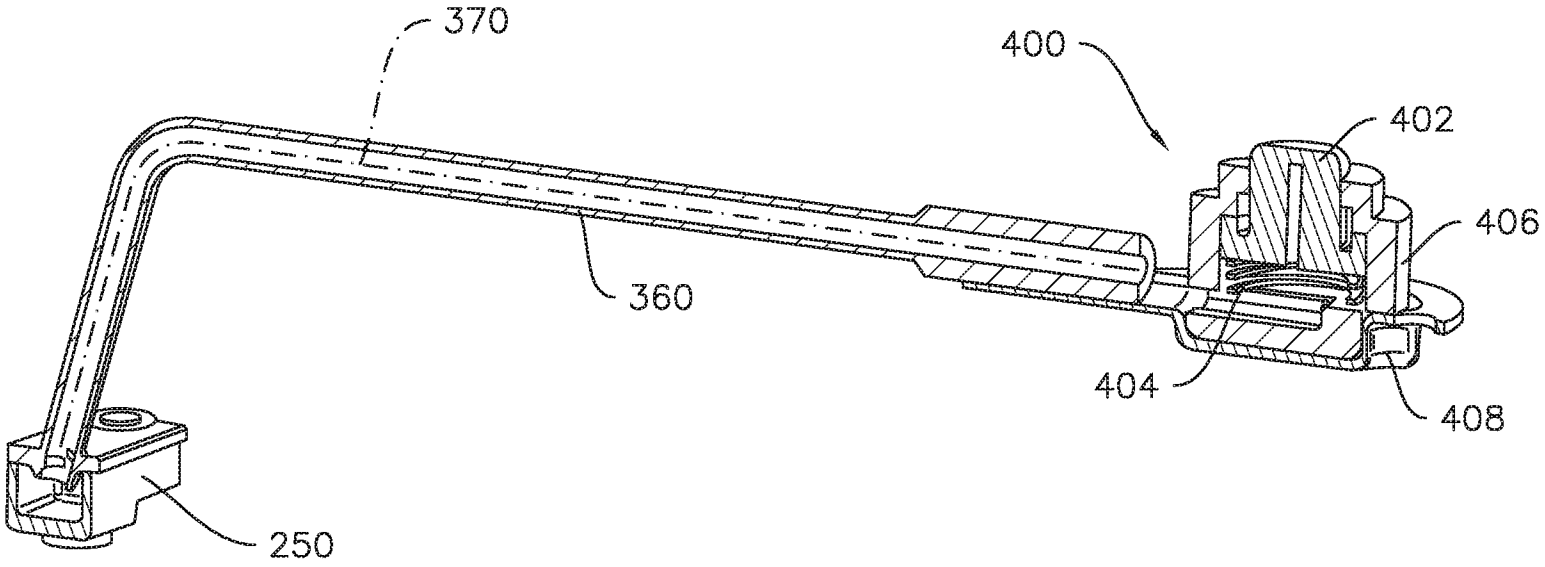
FIG. 9 provides a section view of an example temperature sensor as may be incorporated into a cooktop appliance in one or more example embodiments of the present disclosure.

As may be seen, e.g., in FIGS. 5 and 9, temperature sensor 400 may include a probe 402, a spring 404, a casing 406, and a cover 408. Probe 402 may be coupled to spring 404, such that probe 402 is urged upwardly, e.g., towards a utensil or the griddle plate 310 on grate 302, by spring 404. Probe 402 and spring 404 may be positioned within the casing 406, and casing 406 may be mounted to sensor finger 330. Cover 408 may also be mounted to the sensor finger 330 within or adjacent to the slot 332 at the bottom 334 of sensor finger 330. Cover 408 may be positioned between probe 402 and gas burner 240, e.g., along the vertical direction V. Thus, cover 408 may advantageously shield probe 402 from direct heating by gas burner 240. For example, cover 408 may reduce direct convective heat transfer from flames at gas burner 240 to probe 402, and/or cover 408 may shield probe 402 from direct convective heat transfer from air heated by gas burner 240.

Gas burner assembly 200 may also include a first pogo pin terminal block 250 and a second pogo pin terminal block 252. First pogo pin terminal block 250 may be mounted to grate 302. First pogo pin terminal block 250 may also be positioned at one or more of the legs 322, second end 338 of sensor finger 330, and second end 339 of slot 332. Second pogo pin terminal block 252 is positioned on the top surface 104 of the panel 102. Second pogo pin terminal block 252 on panel 102 is connected to first pogo pin terminal block 250, e.g., when grate 302 is positioned on the top surface 104 of the panel 102 over gas burner 240.

The connection between first and second pogo pin terminal blocks 250, 252 allows signal communication between temperature sensor 400 and controller 130 of cooktop appliance 100. Thus, temperature measurements or other suitable control signals may be transmitted from temperature sensor 400 via the connection between first and second pogo pin terminal blocks 250, 252. Each of first and second pogo pin terminal blocks 250, 252 includes a respective one of at least two spring loaded pins 256 and at least two contact pads 258. For example, first pogo pin terminal block 250 may include two contact pads 258, and second pogo pin terminal block 252 may include two spring loaded pins 256. In alternative example embodiments, the relative position of spring loaded pins 256 and contact pads 258 on first and second pogo pin terminal blocks 250, 252 may be reversed.

A tubular sheath 360 is positioned within slot 332, and tubular sheath 360 may extend between temperature sensor 400 and first pogo pin terminal block 250 in slot 332. Tubular sheath 360 may be a metal tubular sheath, such as, steel, or other suitable material such as ceramic.

A wire 370 extends through tubular sheath 360 between temperature sensor 400 and first pogo pin terminal block 250. Wire 370 connects temperature sensor 400 and first pogo pin terminal block 250 to place temperature sensor 400 and first pogo pin terminal block 250 in signal communication with each other. Thus, wire 370 may transmit electrical signals between temperature sensor 400 and first pogo pin terminal block 250. Wire 370 may include a woven fiberglass jacket or a woven steel mesh jacket. Such construction of wire 370 may advantageously limit heat transfer between tubular sheath 360 and wire 370. Thus, wire 370 within tubular sheath 360 may be insulated for high temperatures.

Such construction of the sensor finger 330 and temperature sensor 400 provides numerous advantages. For example, temperature sensor 400 is advantageously positioned proximate the griddle plate 310 or utensil on the grate 302 yet temperature sensor 400 and wire 370 are also shielded by sensor finger 330, cover 408, and tubular sheath 360 from direct convective heating from gas burner 240. As another example, the first and second pogo pin terminal blocks 250, 252 also allow grate 302 to be removed from the panel 102 without the need to manually disconnect any wiring. First and second pogo pin terminal blocks 250, 252 may also accommodate variation in positioning of grate 302 on top panel 102 while also maintaining good electrical signal. The foregoing advantages are described by way of example only and without limitation. Additional advantages of the present disclosure may also be apparent to those of ordinary skill in the art.

Figure 11:
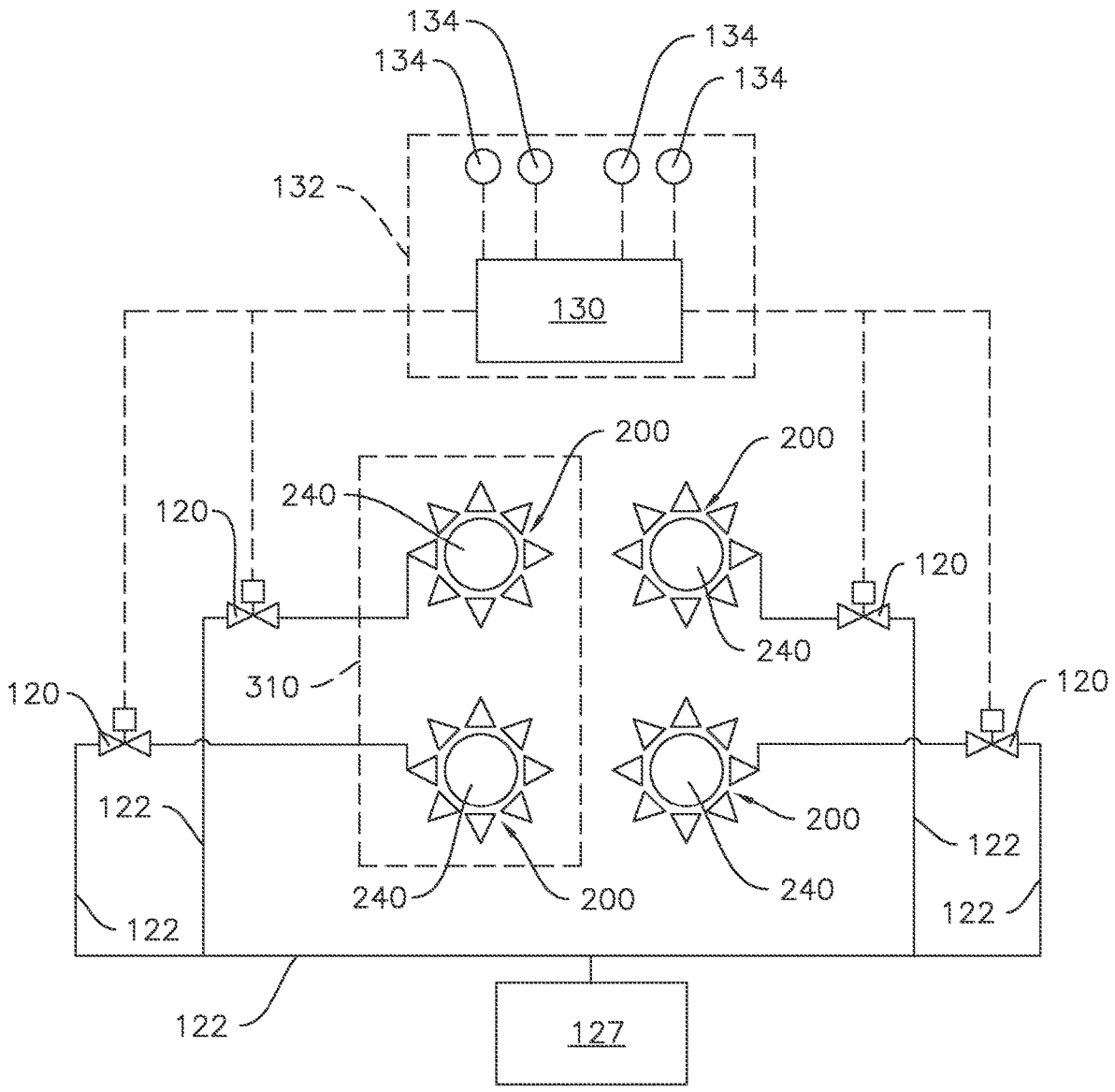
FIG. 11 provides a schematic view of a cooktop appliance according to one or more example embodiments of the present disclosure.

Turning to FIGS. 10 and 11, schematic views of an example cooktop appliance 100 are provided. Specifically, FIG. 10 provides a cross-sectional schematic view of the cooktop appliance along the line 10-10 of FIG. 1. FIG. 11 provides a general schematic view of the cooktop appliance 100.

As shown in FIG. 10, the griddle plate 310 may be selectively disposed over (e.g., directly above) a corresponding spaced-apart pair of burner assemblies (e.g., a first gas burner assembly 200 and second gas burner assembly 200). For example, the burner assemblies 200 (and/or burners 240 thereof) may be spaced apart along one or both of the lateral direction L and the transverse direction T, such as spaced apart within a lateral-transverse plane which is perpendicular to the vertical direction V and is defined by the lateral direction L and the transverse direction T. During use, top cooking surface 312 faces away from panel 102 to receive a cooking item (e.g., food) thereon. By contrast, bottom heating surface 314 may be opposite from top cooking surface 312 and may face panel 102 during use. Thus, bottom heating surface 314 may face the panel 102 to receive a thermal output (e.g., flame or heated air) from the corresponding burners 240 of the first gas burner assembly 200 and second gas burner assembly 200, respectively. As described above, fuel, such as propane or natural gas, may flow through the corresponding first and second gas control valves 120. As shown, gas control valves 120 generally provide or are disposed along parallel gas flow paths. From the first and second control valves 120, fuel may flow to one or both (e.g., when both control valves 120 are at least partially open) of the corresponding first and second burners 240.

Generally, it is understood that the first and second gas burner assemblies 200A, 200B may be identically or uniquely sized. For instance, the first burner 240 of the first gas burner assembly 200 may define a first output diameter d1 (e.g., at the radial maximum and/or flame port location of the burner 240) while the second burner 240 of the second gas burner assembly 200 defines a second output diameter d2 (e.g., at the radial maximum and/or flame port location of the burner 240). Both output diameters d1, d2 generally correspond to the shape and position of flame output by the respective burners 240. In some embodiments, the first output diameter d1 may be equal to the second output diameter d2. Thus, the flame output by the first burner 240 may be generally equivalent in size to the flame output by the second burner 240 (e.g., when an equivalent gas flow is provided to each burner 240). In alternative embodiments, the first output diameter d1 may be different from (e.g., larger than) the second output diameter d2. Thus, the flame output by the first burner 240 may be larger in size than the flame output by the second burner 240.

As noted above, controller 130 is operably coupled (e.g., electrically coupled via one or more wires or communication busses) to one or more components corresponding to discrete burner assemblies 200. Specifically, controller 130 is operably coupled to the first and second temperature sensors 400 which are positioned over the corresponding burners 240, as well as coupled to the first and second control valves 120 which are each in communication with the same corresponding burners 240, to provide fluid communication from a flammable gas source 127 (e.g., commercial or residential natural gas supply) to the burner assemblies 200, via fuel lines 122. As shown, first control valve 120 is in fluid communication with the first gas burner assembly 200, while second control valve 120 is in fluid communication with the second gas burner assembly 200. In turn, first and second gas control valves 120 may operate to selectively direct a flow of gas to the first gas burner assembly 200 and the second gas burner assembly 200, respectively (e.g., as instructed by controller 130).

In some embodiments, the controller 130 includes distinct single burner and multi-burner modes, e.g., the multi-burner mode may be usable with the griddle plate 310 to provide consistent heat across the griddle plate 310. For instance, controller 130 may be configured to alternately operate the first and second gas burner assemblies 200 in a single burner mode and a multi-burner mode. Generally, the single burner mode will provide for operating the first gas burner assembly 200 and the second gas burner assembly 200 independently. In turn, the first gas burner assembly 200 may be active while the second gas burner assembly 200 remains inactive (or otherwise active at a different heat output setting), and vice versa. By contrast the multi-burner mode will provide for operating the first gas burner assembly 200 and the second gas burner assembly 200 together or in concert with each other, e.g., based on a common set temperature.

In certain embodiments of the single burner mode, the controller 130 may receive separate independent commands for the first gas burner assembly 200 and the second gas burner assembly 200 as well as separate and independent temperature measurements from the first and second temperature sensors 400. Individual commands may generally direct a desired heat output at only the first burner 240 or the second burner 240. The actual heat output at each burner 240 will generally correspond to the amount of gas flowed to that burner 240. The control valves 120 may be positioned (e.g., such that an opening for gas is expanded or contracted) according to the directed heat outputs. In other words, the opening for gas through the first control valve 120 may increase or decrease based on one directed heat output or command, while the opening for gas through the second control valve 120 increases or decreases based on another directed heat output or command. As a result, the first gas burner assembly 200 may be active (e.g., to expel gas for flame production) while the second gas burner assembly 200 is inactive (e.g., such that no gas is expelled therethrough), and vice versa. Moreover, the first gas burner assembly 200 may be active to provide a first level of heat output while the second gas burner assembly 200 is active to provide a second level of heat output (e.g., a greater or lesser heat output than the first heat output). Further, the actual heat output at each burner 240 may be separately monitored or measured with each corresponding temperature sensor 400, and, in the single burner mode, the position of the first control valve 120 may be adjusted based on a measured temperature measured by the first temperature sensor 400 and the directed heat output for the first burner 240 while the position of the second control valve 120 may be separately and independently adjusted based on a measured temperature measured by the second temperature sensor 400 and the directed heat output for the second burner 240.

By contrast to the single burner mode, in certain embodiments of the multi-burner mode, the controller 130 may receive a combined command, such as a single set temperature, e.g., for use with the griddle assembly, for the first gas burner 240 and the second gas burner 240. The combined command may generally direct a desired heat output for both the first burner 240 and the second burner 240 to achieve the same set temperature at each burner 240. For example, the set temperature may be entered at the user interface panel 110.

The heat output of each burner may be determined based on the set temperature and a measured temperature during the multi-burner mode. For example, the heat output of the first burner 240 may be determined based on the set temperature and a first measured temperature measured by the first temperature sensor 400, while the heat output of the second burner 240 may be determined based on the set temperature and a second measured temperature measured by the second temperature sensor 400. The set temperature and the or each measured temperature may be input into a closed-loop control algorithm, such as a proportional-integral-derivative (PID) control loop. The closed-loop control algorithm may output a desired heat output at each of the burners 240 and/or a flow rate (e.g., the volumetric flow rate in cubic meters per second) of gas to the respective burners 240. Additionally or alternatively, the closed-loop control algorithm may output desired relative positions of each control valve 120 which correlate to the desired heat output (i.e., the degree of rotation corresponding to the relative size of the opening for gas through each control valve 120 which will provide the desired heat level at the griddle).

Referring still to FIGS. 10 and 11, in some embodiments, e.g., as illustrated in FIG. 11, controller 130 is further operably coupled to a user interface 132 providing one or more inputs for operating the burner assemblies 200. For instance, user interface 132 may include a touch panel, such as capacitive touch screen, configured to transmit one or more input signals to the controller 130, e.g., based on a directed heat output provided by a user. Additionally or alternatively, user interface 132 may include one or more physical control inputs 134 (e.g., knobs 112 as described above with respect to FIG. 1). For instance, a separate control input 134 may be provided for each burner assembly 200. In the single burner mode, the control inputs 134 may allow the user to activate each burner assembly 200 separately and independently during single-burner mode. The control inputs 134 may generally determine a heat output at each corresponding burner assembly 200. In turn, the first control valve 120 may be independently positioned based on a relative position (e.g., rotated position) of a first control input 134, and the second control valve 120 may be independently positioned based on a relative position (e.g., rotated position) of a second control input 134 in the single-burner mode.

In optional embodiments, the multi-burner mode may change the functionality of one or more control input 134. For instance, the first control input 134 may be associated with both the first control valve 120 and the second control valve 120, e.g., to define the common set temperature for both the first burner 240 and the second burner 240, such as when the griddle plate 310 is positioned over the first and second burners 240. In turn, both associated valves 120 may be positioned cooperatively based on the first control input 134, e.g., the heat output correlating to the first control input 134 may be a set temperature or target temperature, and the valves 120 may be adjusted based on the set temperature as compared to the measured temperature, as described above. For instance, cooperatively positioning the first and second control valves 120 may include simultaneously positioning the first control valve 120 and the second control valve 120 according to a relative position (e.g., rotational position) of the first control input 134, e.g., based at least in part on the set temperature determined by or corresponding to the position of the control input 134. In turn, the relative position of the first control input 134 may simultaneously determine (at least in part, e.g., in combination with the respective measured temperatures) the heat output at both the first burner 240 and the second burner 240 in the multi-burner mode.

Figure 12:
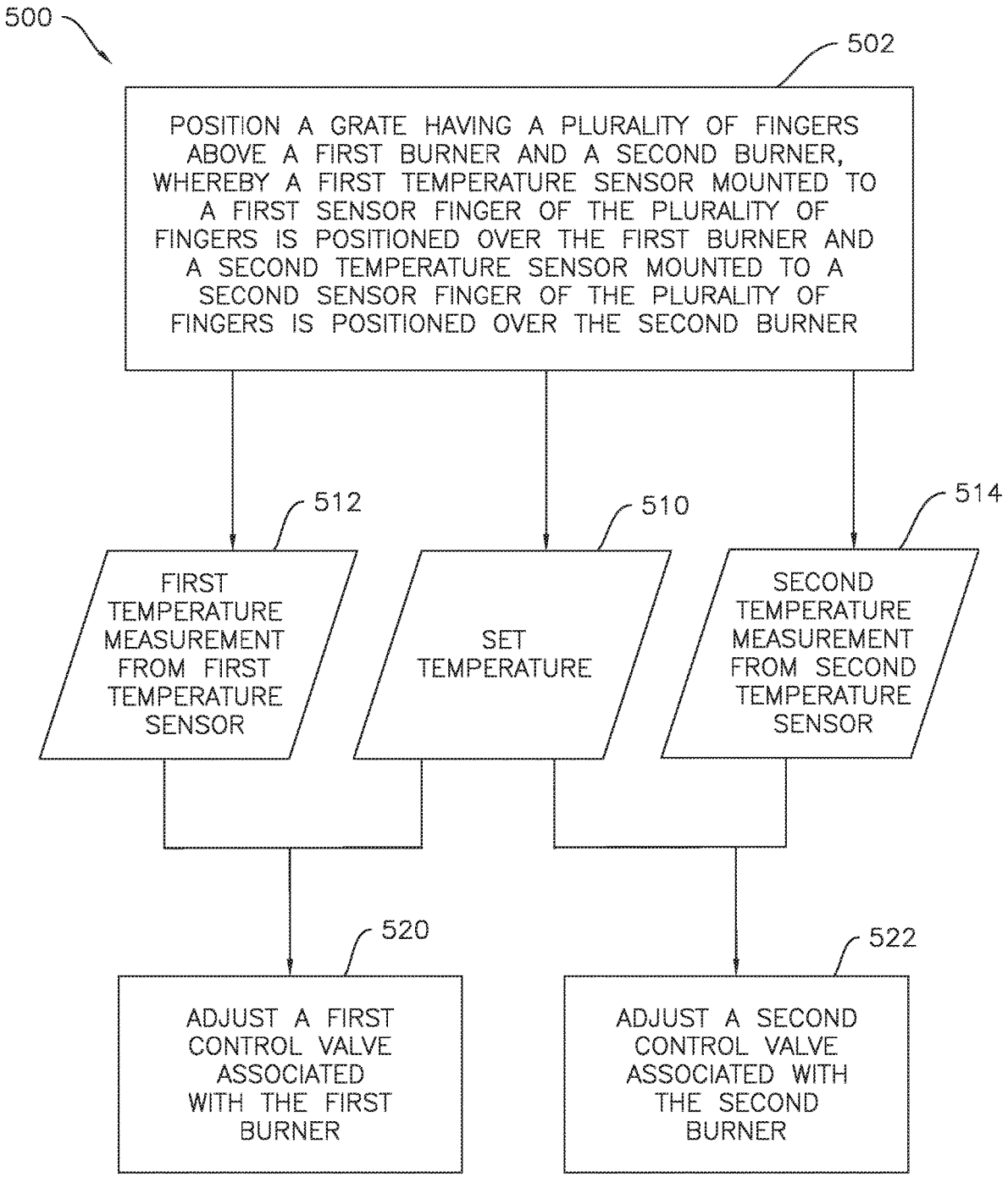
FIG. 12 provides a flow chart illustrating a method of operating a cooktop appliance in accordance with one or more example embodiments of the present disclosure.

Turning now to FIG. 12, FIG. 12 provides a flow chart of a method 500 according to example embodiments of the present disclosure. Generally, the method 500 provides a method of operating a cooktop appliance 100 (e.g., as an operation routine). Specifically, method 500 provides for controlling operation of at least a first gas burner assembly 200 and a second gas burner assembly 200 of a cooktop appliance 100 (e.g., as shown in FIG. 11). As described above, the cooktop appliance 100 may include a panel 102, a first burner 240 in fluid communication with a first control valve 120, and a second burner 240 in fluid communication with a second control valve 120. Moreover, the second burner 240 is spaced apart from the first burner 240. The second control valve 120 is disposed along a parallel flow to the first control valve 120. The method 500 may be performed, for instance, by the controller 130 in whole or in part. For example, as discussed controller 130 may be operably coupled to the first and second burners 240, first and second control valves 120, and first and second temperature sensors 400, as well as a user interface 132. Controller 130 may further be in communication with other suitable components of the appliance 100 to facilitate operation of the appliance 100, generally. It is understood that FIG. 12 depicts steps performed in a particular order for purpose of illustration and discussion. Those of ordinary skill in the art, using the disclosures provided herein, will understand that the steps of any of the methods disclosed herein can be modified, adapted, rearranged, omitted, or expanded in various ways without deviating from the scope of the present disclosure, except as otherwise indicated.

As illustrated at step 502 in FIG. 12, the method 500 may include positioning a grate having a plurality of fingers above a first burner and a second burner. For example, the grate may be positioned above the burners after removing one or more removable grates which provide a support surface for a cooking utensil, and the grate may include a support surface, which may be a discontinuous surface defined across the plurality of discrete fingers of the grate, for a griddle plate. As a result of positioning the grate, a first temperature sensor mounted to a first sensor finger of the plurality of fingers is positioned over the first burner and a second temperature sensor mounted to a second sensor finger of the plurality of fingers is positioned over the second burner.

At 510, the method 500 includes receiving an input signal from the user interface. For instance, an input signal may be provided at the user input 110 and/or 132. The input signal may generally indicate a desired set temperature for the griddle plate 310 in a multi-burner mode. At 512, the method 500 includes receiving a first temperature measurement from the first temperature sensor and at 514, the method 500 includes receiving a second temperature measurement from the second temperature sensor. After receiving the set temperature and the first and second temperature measurements, the method 500 includes, at step 520, adjusting a first control valve in fluid communication with the first burner based on the first temperature measurement and the set temperature and, at step 522, adjusting a second control valve in fluid communication with the second burner based on the second temperature measurement and the set temperature.

For example, the control valves may be adjusted based on a difference between the set temperature and the temperature measurement at the burner with which each control valve is associated. Such embodiments may include a closed loop control algorithm, such as a PID control algorithm. In some embodiments, the method 500 may include calculating a difference between the first temperature measurement and the set temperature and calculating a difference between the second temperature measurement and the set temperature. In such embodiments, adjusting the first control valve based on the first temperature measurement and the set temperature may include adjusting the first control valve based on the calculated difference between the first temperature measurement and the set temperature, and adjusting the second control valve based on the second temperature measurement and the set temperature may include adjusting the second control valve based on the calculated difference between the second temperature measurement and the set temperature.

In additional exemplary embodiments, the method 500 may also include applying a gain to the calculated difference between the first temperature measurement and the set temperature and applying the gain to the calculated difference between the second temperature measurement and the set temperature. Such embodiments may also include adjusting the first control valve based on the calculated difference between the first temperature measurement and the set temperature after applying the gain to the calculated difference between the first temperature measurement and the set temperature and adjusting the second control valve based on the calculated difference between the second temperature measurement and the set temperature after applying the gain to the calculated difference between the second temperature measurement and the set temperature.

As mentioned, the grate may include a support surface or surfaces for a griddle plate. In such embodiments, the griddle plate may be disposed on the grate during operation of the cooktop appliance, such as during the method 500 described above. For example, the bottom surface 314 of the griddle plate 310 may face the burners 240A and 240B, such that the first temperature measurement is a first surface temperature measurement of the bottom surface 314 of the griddle plate 310 and the second temperature measurement is a second surface temperature measurement of a distinction location on the bottom surface 314 of the griddle plate 310. For example, the first location may be proximate, such as directly above and/or concentric with, the first burner and the second location may be distinct and spaced apart from the first location just as the second burner is spaced apart from the first burner. For instance, the second location may be proximate, such as directly above and/or concentric with, the second burner. In some embodiments, the first temperature sensor may be positioned directly above a geometric center of the first burner and the second temperature measurement sensor may be positioned directly above a geometric center of the second burner.

Additionally, in some embodiments, the step 502 of positioning the grate may also include contacting a first pogo pin terminal block mounted to the first sensor finger with a third pogo pin terminal block mounted to the panel of the cooktop appliance and contacting a second pogo pin terminal block mounted to the second sensor finger with a fourth pogo pin terminal block mounted to the panel. Thus, the first temperature sensor is in communication with a controller of the cooktop appliance via the connection between the first pogo pin terminal block and the third pogo pin terminal block, and the second temperature sensor is in communication with the controller of the cooktop appliance via the connection between the second pogo pin terminal block and the fourth pogo pin terminal block.

In some exemplary embodiments, contacting the first pogo pin terminal block mounted to the first sensor finger with the third pogo pin terminal block mounted to the panel may include contacting at least two spring-loaded contact pins on one of the first pogo pin terminal block and the third pogo pin terminal block with at least two contact pads on the other of the first pogo pin terminal block and the third pogo pin terminal block. Also, in such embodiments, contacting the second pogo pin terminal block mounted to the first sensor finger with the fourth pogo pin terminal block mounted to the panel may include contacting at least two spring-loaded contact pins on one of the second pogo pin terminal block and the fourth pogo pin terminal block with at least two contact pads on the other of the second pogo pin terminal block and the fourth pogo pin terminal block.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance comprising:

a first burner disposed on a panel of the cooktop appliance;

a second burner spaced apart from the first burner on the panel;

a grate with a plurality of fingers positioned above the first burner and the second burner, the plurality of fingers comprising a first sensor finger with a first temperature sensor mounted thereto positioned over the first burner and a second sensor finger with a second temperature sensor mounted thereto positioned over the second burner;

a first control valve in fluid communication with the first burner to selectively direct a flow of gas thereto;

a second control valve in fluid communication with the second burner to selectively direct a flow of gas thereto; and a controller operably coupled to the first temperature sensor, the second temperature sensor, the first control valve, and the second control valve, the controller operable to:

receive a combined command for the first burner and the second burner, the combined command consisting of a single set temperature for the first burner and the second burner;

receive a first temperature measurement from the first temperature sensor;

receive a second temperature measurement from the second temperature sensor;

adjust the first control valve based on the first temperature measurement and the single set temperature; and adjust the second control valve based on the second temperature measurement and the single set temperature, wherein the controller is operable to simultaneously adjust the first control valve based on the first temperature measurement and the single set temperature and adjust the second control valve based on the second temperature measurement and the single set temperature.

2. The cooktop appliance of claim 1, further comprising a griddle plate disposed on the grate, the griddle plate spanning the first burner and the second burner, the griddle plate having a bottom surface that faces a top surface of the panel, wherein the first temperature sensor and the second temperature sensor are in contact with the bottom surface of the griddle plate when the griddle plate is disposed on the grate.

3. The cooktop appliance of claim 1, wherein the grate spans the first burner and the second burner.

4. The cooktop appliance of claim 1, wherein the first temperature sensor is positioned directly above a geometric center of the first burner and the second temperature sensor is positioned directly above a geometric center of the second burner.

5. The cooktop appliance of claim 1, wherein the first sensor finger defines a first open slot facing towards the panel and the second sensor finger defines a second open slot facing towards the panel, wherein the first temperature sensor is mounted to the first sensor finger at a first end of the first slot, and the second temperature sensor is mounted to the second sensor finger at a first end of the second slot.

6. The cooktop appliance of claim 5, further comprising a first pogo pin terminal block mounted to a second end of the first open slot and a second pogo pin terminal block mounted to a second end of the second open slot.

7. The cooktop appliance of claim 6, further comprising a first wire extending through the first open slot from the first pogo pin terminal block to the first temperature sensor and a second wire extending through the second open slot from the second pogo pin terminal block to the second temperature sensor.

8. The cooktop appliance of claim 7, wherein the first pogo pin terminal block and the second pogo pin terminal block each comprise at least two spring-loaded pins.

9. The cooktop appliance of claim 7, wherein the first pogo pin terminal block and the second pogo pin terminal block each comprise at least two contact pads.

10. The cooktop appliance of claim 1, further comprising a first cover mounted to the first sensor finger such that the first cover is positioned between the first temperature sensor and the first burner and a second cover mounted to the second sensor finger such that the second cover is positioned between the second temperature sensor and the second burner.

11. A method of operating a cooktop appliance, the cooktop appliance comprising a first burner, a second burner spaced apart from the first burner, and a grate having a plurality of fingers, the method comprising:

receiving a combined command for the first burner and the second burner, the combined command consisting of a single set temperature;

receiving a first temperature measurement from a first temperature sensor positioned above the first burner and mounted to a first sensor finger of the plurality of fingers;

receiving a second temperature measurement from a second temperature sensor positioned over the second burner and mounted to a second sensor finger of the plurality of fingers;

adjusting a first control valve in fluid communication with the first burner based on the first temperature measurement and the single set temperature; and adjusting a second control valve in fluid communication with the second burner based on the second temperature measurement and the single set temperature, wherein the step of adjusting the first control valve and the step of adjusting the second control valve are performed simultaneously.

12. The method of claim 11, wherein the cooktop appliance further comprises a griddle plate disposed on the grate, wherein the first temperature measurement is a first surface temperature measurement of a bottom surface of the griddle plate and the second temperature measurement is a second surface temperature measurement of a distinct distinction location on the bottom surface of the griddle plate.

13. The method of claim 11, wherein the first temperature measurement is received from the first temperature sensor positioned directly above a geometric center of the first burner and the second temperature measurement is received from the second temperature sensor positioned directly above a geometric center of the second burner.

14. The method of claim 11, further comprising positioning the grate above the first burner and the second burner such that the grate spans the first burner and the second burner.

15. The method of claim 14, wherein positioning the grate above the first burner and the second burner further comprises contacting a first pogo pin terminal block mounted to the first sensor finger with a third pogo pin terminal block mounted to a panel of the cooktop appliance and contacting a second pogo pin terminal block mounted to the second sensor finger with a fourth pogo pin terminal block mounted to the panel, whereby the first temperature sensor is in communication with a controller of the cooktop appliance via the connection between the first pogo pin terminal block and the third pogo pin terminal block, and the second temperature sensor is in communication with the controller of the cooktop appliance via the connection between the second pogo pin terminal block and the fourth pogo pin terminal block.

16. The method of claim 15, wherein contacting the first pogo pin terminal block mounted to the first sensor finger with the third pogo pin terminal block mounted to the panel comprises contacting at least two spring-loaded contact pins on one of the first pogo pin terminal block and the third pogo pin terminal block with at least two contact pads on the other of the first pogo pin terminal block and the third pogo pin terminal block, and wherein contacting the second pogo pin terminal block mounted to the first sensor finger with the fourth pogo pin terminal block mounted to the panel comprises contacting at least two spring-loaded contact pins on one of the second pogo pin terminal block and the fourth pogo pin terminal block with at least two contact pads on the other of the second pogo pin terminal block and the fourth pogo pin terminal block.

17. The method of claim 11, further comprising calculating a difference between the first temperature measurement and the single set temperature and calculating a difference between the second temperature measurement and the single set temperature, wherein adjusting the first control valve based on the first temperature measurement and the single set temperature comprises adjusting the first control valve based on the calculated difference between the first temperature measurement and the single set temperature, and wherein adjusting the second control valve based on the second temperature measurement and the single set temperature comprises adjusting the second control valve based on the calculated difference between the second temperature measurement and the single set temperature.

18. The method of claim 17, further comprising applying a gain to the calculated difference between the first temperature measurement and the single set temperature, applying the gain to the calculated difference between the second temperature measurement and the single set temperature, adjusting the first control valve based on the calculated difference between the first temperature measurement and the single set temperature after applying the gain to the calculated difference between the first temperature measurement and the single set temperature, and adjusting the second control valve based on the calculated difference between the second temperature measurement and the single set temperature after applying the gain to the calculated difference between the second temperature measurement and the single set temperature.

* * * * *